US008764392B2

(12) United States Patent
Penalver Castro et al.

(10) Patent No.: US 8,764,392 B2
(45) Date of Patent: Jul. 1, 2014

(54) BLADE RETENTION AT A COMPRESSOR RECTIFIER STAGE FOR IMPACT RESISTANCE

(75) Inventors: Enrique Penalver Castro, Soumagne (BE); Yves Culot, Liège (BE)

(73) Assignee: Techspace Aero S.A. (BE)

( * ) Notice: Subject to any disclaimer, the term of this patent is extended or adjusted under 35 U.S.C. 154(b) by 603 days.

(21) Appl. No.: 12/644,101

(22) Filed: Dec. 22, 2009

(65) Prior Publication Data

US 2011/0002787 A1 Jan. 6, 2011

(30) Foreign Application Priority Data

Dec. 24, 2008 (EP) ..... 08172916

(51) Int. Cl.
*F01D 5/32* (2006.01)

(52) U.S. Cl.
USPC ..... 415/209.4; 415/189; 415/209.2

(58) Field of Classification Search
USPC ..... 415/211.2, 174.5, 189, 209.1–4, 190, 415/210.1; 416/220 R, 204 R
See application file for complete search history.

(56) References Cited

U.S. PATENT DOCUMENTS

| | | | | |
|---|---|---|---|---|
| 5,601,407 | A * | 2/1997 | Humhauser | 415/209.2 |
| 6,595,747 | B2 * | 7/2003 | Bos | 415/209.4 |
| 2005/0232760 | A1 * | 10/2005 | Wagner | 415/191 |

FOREIGN PATENT DOCUMENTS

| | | | |
|---|---|---|---|
| DE | 862158 | C | 1/1953 |
| EP | 1213484 | A1 | 6/2002 |
| FR | 1380241 | A | 11/1964 |
| GB | 700012 | A | 11/1953 |
| GB | 732622 | | 6/1955 |
| GB | 732919 | A | 6/1955 |

* cited by examiner

*Primary Examiner* — Edward Landrum
*Assistant Examiner* — Justin Seabe
(74) *Attorney, Agent, or Firm* — James E. Walton; Richard G. Eldredge

(57) ABSTRACT

A rectifier stage of an axial turbine engine compressor is placed directly downstream of the input blower of a turbo-reactor or turboshaft engine compressor. The blade roots of the rectifier stage are housed inside the inner shroud by insertion into respective slots. The blade roots include at least one opening protruding from the slot of the shroud, so as to receive a spiral ring having at least two loops so as to prevent the blade roots from escaping from the respective slots of the inner shroud, and so as to form a connection between the blade roots. A method for retaining blades of a rectifier stage of an axial turbine engine compressor on an inner shroud, in particular a rectifier stage placed directly downstream of the input blower of a turbo-reactor or turboshaft engine compressor, includes positioning a spiral ring having at least two loops inside the openings of the blade roots by threading one end of the ring successively into the openings until all of the spirals of the ring are housed inside the openings.

15 Claims, 1 Drawing Sheet

BLADE RETENTION AT A COMPRESSOR RECTIFIER STAGE FOR IMPACT RESISTANCE

This application claims priority under 35 U.S.C. §119 to European Patent Application No. 08172916.2, filed 24 Dec. 2008, titled "Blade Retention at a Compressor Rectifier Stage for Impact Resistance," which is incorporated herein by reference for all purposes.

BACKGROUND

1. Field of the Application

The present application relates to a rectifier stage of an axial turbine engine compressor, in particular a rectifier stage placed directly downstream of the input blower of a turbo-reactor or turboshaft engine compressor. The subject application also relates to a compressor comprising such a rectifier and a method for retaining blades of a rectifier stage of an axial turbine engine compressor, in particular a rectifier stage placed directly downstream of the blower at the input of a turbo-reactor or turboshaft engine compressor.

2. Description of Related Art

The first rectifier stage of a turbo-reactor or turboshaft engine must meet special requirements regarding blade resistance to the impact or intrusion of a foreign object. Indeed, in flight, turbo-reactors and turboshaft engines are likely to suck in various types of foreign objects, such as, for instance, ice or birds. The blower at the engine front is dimensioned to resist this kind of stress, but it still remains that this kind of foreign object may not be sufficiently destroyed by the blower so as to pass through the engine without causing further damage. Indeed, the rectifier stage directly downstream of the blower can also be subject to damage through this kind of foreign object. The blades of this stage may be distorted by the impact of the foreign object and possibly become dislodged, in particular at the inner shroud. A dislodged blade would cause very serious damage to the turbine engine in comparison with a foreign object of the above-mentioned kind and is by all means to be prevented. Fastening of the blades to the rectifier stage at the outer shroud is usually done by welding, riveting, or screwing. This kind of connection is rather stiff and resistant in comparison with the connection to the inner shroud, which is generally ensured by embedding or countersinking the end of the blade into some damping material. Therefore, it is necessary to use locking systems at the blade root.

GB 700,012 discloses a scheme for fastening stator blades to an outer shroud, as well as an inner shroud, wherein the ends of the blades are inserted into respective slots in the inner and outer shrouds, and wherein a wire acting as a hook is passed through openings in the ends of the blades. However, this document does not specify the length of the wire and does not specify how the wire is inserted into the openings. With regard to the teachings of this document it appears that inserting the wire into the openings of several successive blades is probably made very difficult because of the stiffness of the wire and the reduced clearance provided between the wire and the orifices.

GB 732,919 discloses a scheme for fastening stator blades similar to the preceding document. The blade tips are inserted into respective slots of the stator, and a wire acting as a lock is inserted into openings of the protruding blade tips. The openings are spaced apart from the slots, and the wire is maintained by a metal sheet solidly fastened to the stator and bent over the wire. Moreover, the blades may be spot welded to the metal sheet involved. This document does not specify the length of the wire nor the number of blades held by one wire portion. Nor does it specify how the ends of adjacent wires are joined. However, it is clear that the wire is held in place by bending the end portions of the metal sheet extending between the blades. Just like for the teachings of the preceding document it appears that inserting the wire into the openings of several successive blades is probably made very difficult because of the stiffness of the wire and the reduced clearance provided between the wire and the orifices.

EP 1 213 484 B1 also discloses a similar scheme for fastening blade tips and roots to outer and inner shrouds, wherein a strip or band is inserted into corresponding openings of the blade tips and roots.

The connecting schemes of these documents are limited to locking, i.e., preventing a blade tip or root from escaping from its respective slot. Moreover, they require a final step of fastening the wire or strip.

Although great strides have been made in the area of axial compressors, many shortcomings remain.

DETAILED DESCRIPTION OF THE PREFERRED EMBODIMENT

Figure 1:
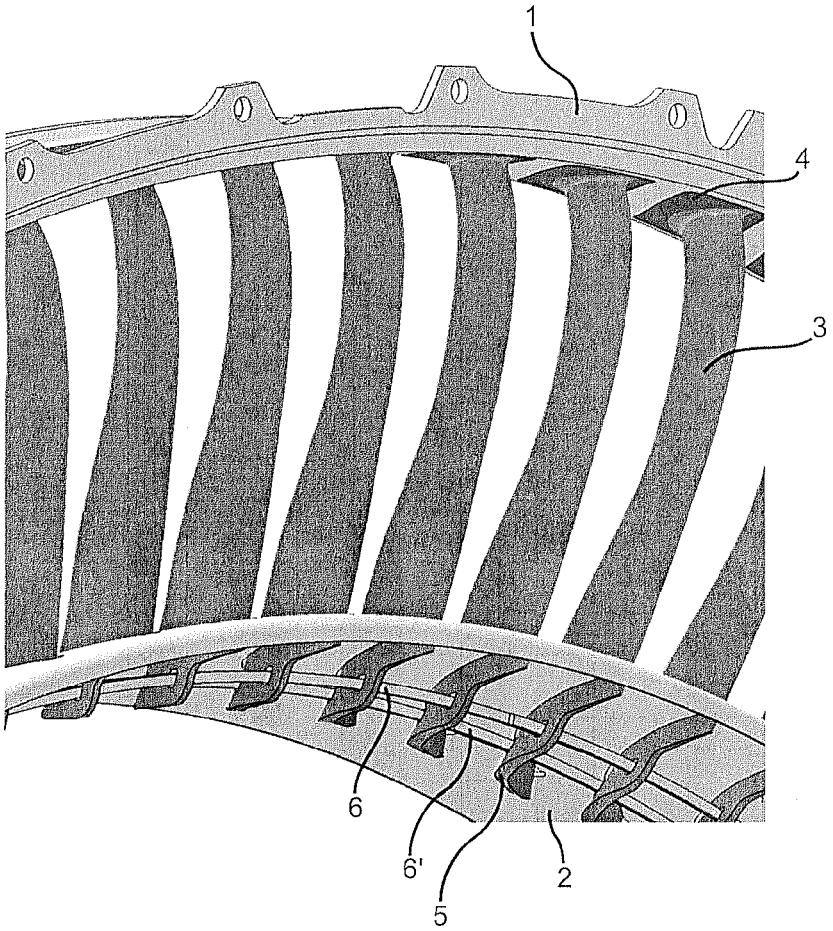
FIG. 1 is a perspective view of a rectifier stage portion of an axial compressor according to the present application.

The present application discloses a rectifier stage of an axial turbine engine compressor, comprising an outer shroud and an inner shroud, both being concentric; a series of blades arranged radially and fastened at the tips thereof to the outer shroud and at the roots thereof to the inner shroud, with the inner shroud comprising a series of cutouts each receiving the root of one blade protruding from the inner shroud, each blade root having at least one opening protruding from the inner side of the inner shroud; wherein a spiral ring comprising at least two loops is housed in the openings so as to prevent the blade roots from escaping from the respective cutouts of the inner shroud and so as to form a connection between the blade roots.

This arrangement has the advantage of providing the double functionality of locking the blades with respect to the inner shroud and holding the blades together while being particularly easy to implement. Indeed, the spiral ring will hold the blades and be capable of deforming by the spirals thereof sliding with respect to each other. Positioning does not require any special tools, and no operation for closing the ring is necessary.

Preferably, the loops of the ring touch when the ring is not operational.

Preferably, the loops of the ring are compressed against each other when the ring is not operational.

Preferably, the ring is made of metallic material, preferably of spring steel.

Preferably, the loops of the ring describe at least two full turns.

Preferably, the diameter of the non-operational ring is substantially the diameter of the circle going through the openings of the blade roots so that the ring is floating inside the openings when it is in place.

Preferably, the diameter of the non-operational ring is slightly smaller than the diameter of the circle going through the openings of the blade roots, preferably between about 92% and about 98%, so that the ring is tensioned when it is in place.

Preferably, the blade roots comprise two rows of spaced apart openings, each row of openings receiving one respective spiral ring.

Preferably, the openings of the blade roots are circular. The circularity of the openings makes them easy to manufacture, such as for instance simply by drilling.

The present application also relates to an axial compressor comprising a blower at the compressor front, and directly downstream of the blower a rectifier stage.

The present application also discloses a method for fastening blades of a rectifier stage of an axial turbine engine compressor to an inner shroud, comprising:

(a) providing blades, the roots of which each comprise an opening for receiving a blocking means;

(b) inserting the root of each blade into a corresponding cutout of the inner shroud so that the opening is protruding from the inner side of the shroud; and (c) positioning a spiral ring comprising at least two loops into the openings of the blade roots by threading one end of the ring successively into the openings until all of the spirals of the ring are housed inside the openings.

Preferably, (a) comprises fastening the blade tips to an outer shroud, and the diameter of the non-operational ring is substantially the diameter of the circle going through the openings of the blade roots so that the ring is floating inside the openings when it is in place.

Alternatively, (a) comprises fastening the blade tips to an outer shroud, and the diameter of the non-operational ring is slightly smaller than the diameter of the circle going through the openings of the blade roots, preferably between about 92% and about 98%, so that the ring is tensioned when it is in place.

A rectifier portion of a turbo-reactor axial compressor is illustrated in FIG. 1. It is the rectifier designed to be placed directly downstream of the blower at the input of the compressor. It is composed of an outer shroud 1, an inner shroud 2, and a series of blades 3 arranged radially between the outer shroud and the inner shroud. The blades 3 are solidly fastened to the outer shroud 1 via the tips 4 thereof. Such fastening is done by welding, riveting, screwing, or any other fastening means. The internal ends or roots 5 of the blades 3 are inserted into cutouts or slots 7 (see FIG. 2) made inside the inner shroud 2. Therefore, the blades may slide freely inside these cutouts. The roots 5 of the blades 3 protruding with respect to the inner shroud are provided with holes or openings into which a spiral ring 6 or 6' is inserted so as to lock the blades inside the inner shroud and also so as to connect all the blades together.

Figure 2:
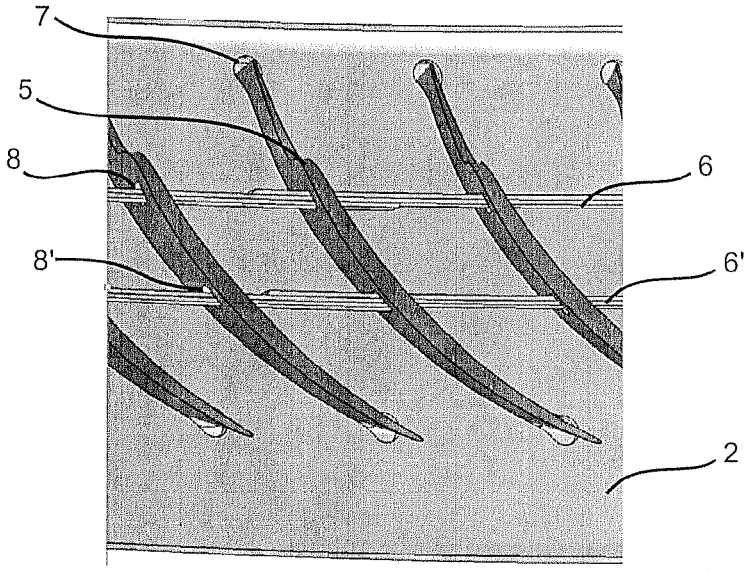
FIG. 2 is an enlarged perspective top view of FIG. 1.

FIG. 2, which is a bottom view of an inner shroud portion of FIG. 1, provides more detail about the connection. The slots or cutouts 7 are made inside the inner shroud 2 so that each slot receives the inner end 5 of a protruding blade. Each protruding blade root comprises two holes or openings 8 and 8'. Due to the constant position of the holes on the blades and the geometrical arrangement of the blades, the holes 8, 8' form two parallel circles. A spiral ring 6, 6' is housed in each series of holes 8 and 8' forming a circle so as to lock the blades with respect to the inner shroud and connect the blades together. As can be seen in FIG. 2, each ring 6, 6' is spiraled and comprises two spirals. This is all the more visible for ring 6, of which both ends are clearly apparent. When starting at the end of the ring 6 opposite the other ring 6', there are in fact two loops counter-clockwise up to the other end. The two ends overlap over a distance so that they have a thickness corresponding to three loops over this distance. The rings are made of resilient material, preferably spring steel, and shaped so that the loops are compressed against each other when they are not operational. Such a ring may be like the rings marketed under the name Spirolox® and currently used in the field of mechanics as a retaining ring on shaft grooves or bores. Due to the large diameter required and other functional requirements, it is possible, or even likely, that such a ring is not available as a standard item and that it may have to be custom made.

It may be supplied in the form of a coil having the desired diameter and a large number of loops, from which the desired number of loops is cut off. The ends of the cut-off ring must then be rounded by means of a grinding wheel or any other adequate tool.

A convenient amount of mechanical clearance is provided between the openings 8, 8' and the portion of the ring 6, 6' to make the mounting operation sufficiently easy. As an example, clearance will be on the order of about 5% to about 60%, more particularly on the order of about 10% to about 30%, at the respective portions of the openings and the ring.

Positioning is done as follows. One end of the ring is detached from the neighboring loop and is inserted into a first hole 8 or 8' of a blade, and then, into the following holes so as to thread the ring progressively, one loop at a time, into the series of holes forming a circle. For this purpose, the end must describe as many turns through the holes as there are loops in the ring. Once the other end of the ring is engaged into the holes, the ring returns to its initial shape, i.e., the various loops thereof stay in touch with each other thus forming a compact and stable ring. Thus, mounting requires no special tools, not to mention any operation for fastening or stabilizing segments or ends of the ring.

The diameter of the non-operational ring is approximately the diameter of the virtual circle going through the holes or openings of the roots of the blades. Once mounted, the ring is relatively floating inside the openings of the blades. Alternatively, a slightly smaller diameter may be provided for the ring so as to tension the blades via the ring. The procedure for mounting the ring is still the same, except for the fact that the process of threading the ring through the openings will be a bit more difficult, in particular once the first loop has been engaged. In this case, the diameter of the non-operational ring will be on the order of about 92% to about 98% of the nominal diameter of the virtual circle going through the openings. Such a configuration provides the advantage that the ring is not floating and pulls all the blades equally towards the middle of the shroud.

A minimum number of loops is required in order to provide the function of automatically closing the ring and maintaining the diameter thereof. Indeed, a minimum of two loops appears to be required for ensuring the stability of the ring. The presence of two loops means in practice about two turns knowing that the last turn may not be a full one. This is the case for certain rings marketed under the name of Spirolox® which comprise two loops both ends of which do not overlap. Of course, more loops or fractions of turns can be envisaged depending among other things on the cross-section of the loops, the diameter of the ring and the stiffness wanted for the ring.

In the example of FIGS. 1 and 2, two identical rings 6 and 6' are provided in order to ensure double fastening of the blades to the inner shroud and among themselves. It is to be noted that it can be envisaged to provide only one ring or else to provide more than two rings depending on the mechanical constraints to be met and space requirements. For example, a single ring could be envisaged having a larger cross-section, or else three rings having smaller cross-sections.

In case of an impact on a blade by a foreign object, like ice or a bird, the blade will be able to deform in flexion in the direction downstream of the flow and will be retained at the inner shroud by the ring(s). Indeed, as can be seen in FIG. 1, the openings of the blade roots are positioned so that they are at a distance from the inner side of the shroud. This provides some freedom to the blades to slide through the cutouts of the shroud in case of an impact by a foreign object. In case of deformation of the blade, the latter will be able to somewhat retract from the inner shroud until the ring comes into abutment against the inner side of the shroud near the cutout. Before coming into abutment, the ring will however exert some retaining effort which increases as the blade retracts. Indeed, the ring is adapted for deforming by the loops thereof sliding with respect to each other, contrary to a ring which is simply closed, e.g., by welding. The construction proposed is thus adapted for guaranteeing that the blades are locked in the inner shroud while ensuring resilient retention of the blades. Moreover, this construction is very simple to implement.

The inner side of the inner shroud is usually designed to be fitted with some abradable material in view of frictional cooperation with one or more lips of the rotor of the compressor. The rings and blade roots are thus likely to be countersunk in one or more layers of materials applied in a paste-like state in view of ensuring this functionality as well as possibly a damping function.

We claim:

1. A rectifier stage of an axial turbine engine compressor, comprising:

an outer shroud and an inner shroud, both being concentric;

a series of blades arranged radially and fastened at tips thereof to the outer shroud;

a series of cutouts arranged about the inner shroud, each cutout being configured such that a root of a corresponding blade protrudes through the inner shroud from the outer side of the inner shroud to the inner side of the inner shroud;

at least one opening located at the root of each blade, each opening being on the inner side of the inner shroud; and a spiral ring having at least one overlapping loop, the spiral ring passing through the openings of each blade so as to prevent the root of each blade from escaping from the respective cutout of the inner shroud, and so as to form a connection between the blade roots; and wherein the diameter of the ring when non-operational is slightly smaller than the diameter of the virtual circle going passing through the openings, such that the ring is tensioned when in place and pulls all the blades equally towards a middle of the inner shroud.

2. The rectifier stage according to claim 1, wherein the loops of the ring touch when the ring is not operational.

3. The rectifier stage according to claim 1, wherein the loops of the ring are compressed against each other when the ring is not operational.

4. The rectifier stage according to claim 1, wherein the ring is made of metallic material.

5. The rectifier stage according to claim 4, wherein the ring is made of spring steel.

6. The rectifier stage according to claim 1, wherein the loops of the ring describe at least two full turns.

7. The rectifier stage according to claim 1, wherein the diameter of the ring is between about 92% and about 98% of the diameter of the circle passing through the openings.

8. The rectifier stage according to claim 1, wherein each blade root comprises:

two rows of spaced-apart openings, each row of openings being configured to receive a respective spiral ring.

9. The rectifier stage according to claim 1, wherein the openings of the blade roots are circular.

10. An axial compressor, comprising:

a blower at the compressor front;

a rectifier stage directly downstream of the blower, the rectifier stage comprising:

an outer shroud;

an inner shroud concentric with the outer shroud;

a series of blades arranged radially and fastened at tips thereof to the outer shroud;

a series of cutouts arranged about the inner shroud, each cutout being configured such that a root of a corresponding blade protrudes through the inner shroud from the outer side of the inner shroud to the inner side of the inner shroud;

at least one opening located at the root of each blade, each opening being on the inner side of the inner shroud; and a spiral ring having at least one overlapping loop, the spiral ring passing through the openings of each blade so as to prevent the root of each blade from escaping from the respective cutout of the inner shroud, and so as to form a connection between the blade roots; and wherein the diameter of the ring when non-operational is slightly smaller than the diameter of the virtual circle going passing through the openings, such that the ring is tensioned when in place and pulls all the blades equally towards a middle of the inner shroud.

11. The axial compressor according to claim 10, wherein the diameter of the ring is between about 92% and about 98% of the diameter of the circle passing through the openings.

12. The axial compressor according to claim 10, wherein each blade root comprises:

two rows of spaced-apart openings, each row of openings being configured to receive a respective ring.

13. A method for fastening blades of a rectifier stage of an axial turbine engine compressor to an inner shroud, comprising:

providing blades the roots of which each comprise at least one opening for receiving a blocking means;

inserting the root of each blade into a corresponding cutout of the inner shroud so that the opening is protruding from the inner side of the shroud; and positioning a spiral ring having at least two loops inside the opening of each blade root by threading one end of the ring successively into the openings until all of the loops of the ring are housed inside the openings;

wherein the diameter of the ring when non-operational is slightly smaller than the diameter of the virtual circle going passing through the openings, such that the ring is tensioned when in place and pulls all the blades equally towards a middle of the inner shroud.

14. The method according to claim 13, further comprising:

fastening the blade tips to an outer shroud.

15. The method according to claim 13, wherein the diameter of the non-operational ring is between about 92% and about 98% of the diameter of the circle passing through the openings of the blade roots, such that the ring is tensioned when in place.

* * * * *